US011359468B2

(12) United States Patent
Roberts et al.

(10) Patent No.: US 11,359,468 B2
(45) Date of Patent: Jun. 14, 2022

(54) OUTWARDLY THREADLESS BULKHEAD FOR PERFORATING GUN

(71) Applicant: Halliburton Energy Services, Inc., Houston, TX (US)

(72) Inventors: Courtney Ann Thain Roberts, Burleson, TX (US); Richard Ellis Robey, Mansfield, TX (US); Christopher C. Hoelscher, Arlington, TX (US); Joseph T. MacGillivray, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/877,386

(22) Filed: May 18, 2020

(65) Prior Publication Data

US 2021/0355797 A1 Nov. 18, 2021

(51) Int. Cl.

| | |
|---|---|
| ***E21B 43/119*** | (2006.01) |
| ***E21B 43/116*** | (2006.01) |
| ***E21B 17/042*** | (2006.01) |
| *E21B 17/02* | (2006.01) |

(52) U.S. Cl.

CPC ..... *E21B 43/119* (2013.01); *E21B 17/042* (2013.01); *E21B 43/116* (2013.01); *E21B 17/028* (2013.01)

(58) Field of Classification Search

CPC .... E21B 43/119; E21B 43/116; E21B 17/042; E21B 17/028

See application file for complete search history.

(56) References Cited

U.S. PATENT DOCUMENTS

| | | | | |
|---|---|---|---|---|
| 4,491,185 | A | 1/1985 | McClure | |
| 4,650,009 | A | 3/1987 | McClure et al. | |
| 5,871,046 | A * | 2/1999 | Robison | E21B 7/061 166/241.1 |
| 6,012,525 | A | 1/2000 | Burleson et al. | |
| 7,013,977 | B2 | 3/2006 | Nordaas | |
| 9,581,422 | B2 | 2/2017 | Preiss et al. | |

(Continued)

FOREIGN PATENT DOCUMENTS

WO 2019098991 A1 5/2019

OTHER PUBLICATIONS

International Search Report and Written Opinion issue for corresponding International PCT Application No. PCT/US2020/035756, dated Feb. 8, 2021.

(Continued)

*Primary Examiner* — Abby J Flynn
*Assistant Examiner* — Yanick A Akaragwe
(74) *Attorney, Agent, or Firm* — McGuireWoods LLP

(57) ABSTRACT

The disclosed embodiments include bulkheads for perforating guns and perforating gun assemblies. A bulkhead includes a threadless exterior surface that spans a length of a threaded connection of adjacent first and second perforating guns. The bulkhead also includes a first exterior groove having a first sealing element partially disposed in the first exterior groove. The bulkhead further includes a second exterior groove having a second sealing element partially disposed in the second exterior groove, where the first sealing element and the second sealing element are positioned around the threaded connection.

16 Claims, 6 Drawing Sheets

(56) References Cited

U.S. PATENT DOCUMENTS

| | | | | |
|---|---|---|---|---|
| 9,677,363 | B2 | 6/2017 | Schacherer et al. | |
| 10,386,168 | B1 * | 8/2019 | Preiss | E21B 43/119 |
| 2012/0247771 | A1 | 10/2012 | Black et al. | |
| 2013/0126237 | A1 | 5/2013 | Burton et al. | |
| 2017/0211363 | A1 | 7/2017 | Bradley et al. | |
| 2017/0276465 | A1 | 9/2017 | Parks et al. | |
| 2018/0299239 | A1 * | 10/2018 | Eitschberger | H05K 5/0034 |

OTHER PUBLICATIONS

Office Action in DE Application No. 10 2021 109 782.7, dated Feb. 8, 2022.

* cited by examiner

OUTWARDLY THREADLESS BULKHEAD FOR PERFORATING GUN

BACKGROUND

The present disclosure relates generally to bulkhead for positioning at the connection between adjacent gun bodies. In one aspect, the present disclosure relates more particularly to a bulkhead having an outwardly threadless portion for facilitating the connection between adjacent gun bodies.

Perforating guns are sometimes used in wireline or tubing-conveyed systems to perforate hydrocarbon production wells. Perforating guns sometime utilize charges or explosives that are set off to perforate the surrounding formation. After perforating guns are lowered into a well to a zone of interest, charges are set off to perforate the surrounding formation. Multiple perforating guns are sometimes strung together to form a perforating gun assembly.

BRIEF DESCRIPTION OF THE DRAWINGS

Illustrative embodiments of the present disclosure are described in detail below with reference to the attached drawing figures, which are incorporated by reference herein, and wherein.

Figure 1:
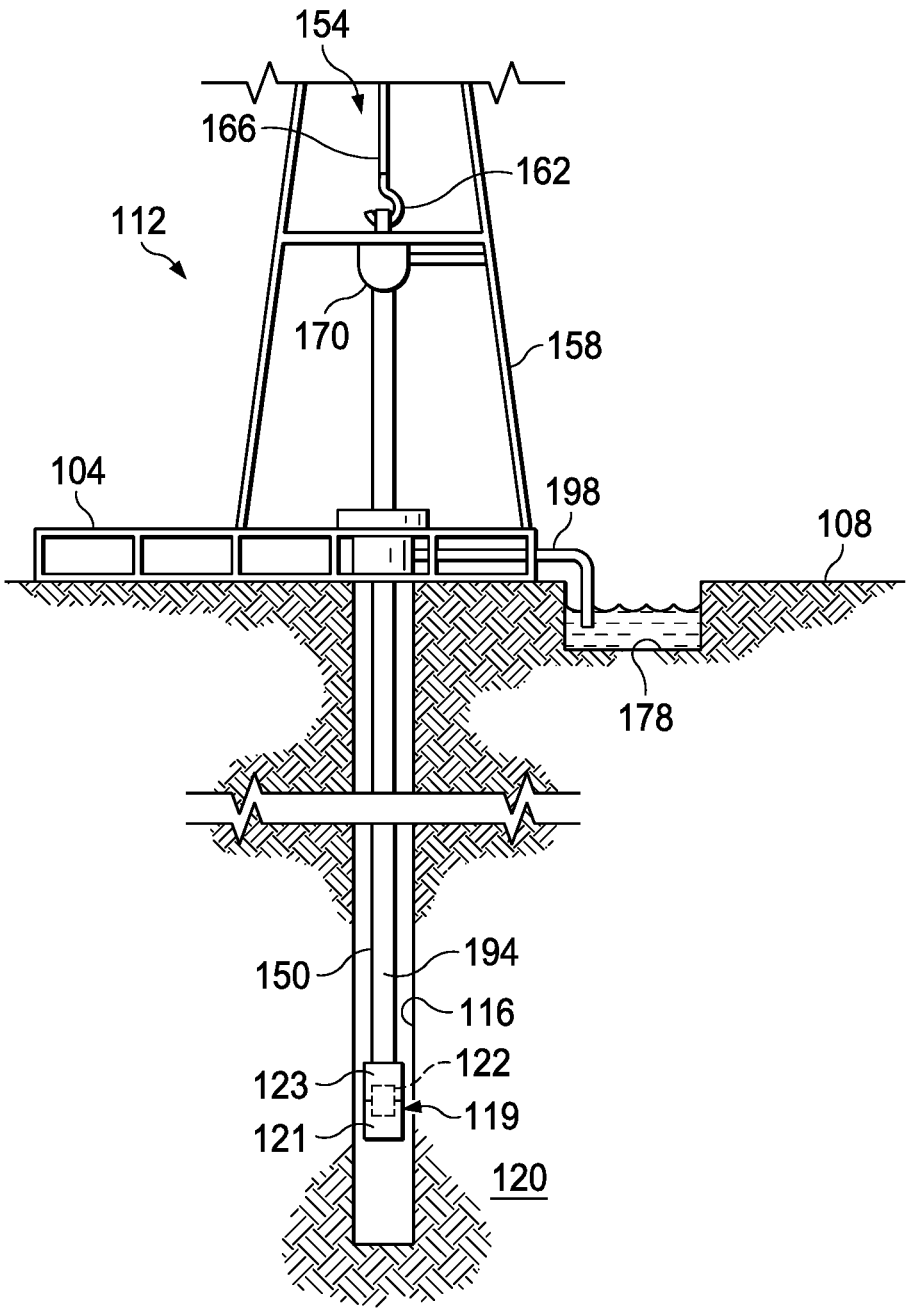
FIG. 1 is a schematic, side view of a well having a perforating gun assembly deployed in a wellbore of the well during a perforating operation.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to perforating guns including aspects of a bulkhead between adjacent gun bodies. A perforating gun assembly has multiple perforating guns connected end to end. Each perforating gun may include a gun body housing various mechanical and/or electrical features or components. The connection between adjacent perforating guns may be made up between adjacent ends of the respective gun bodies. A bulkhead may be positioned between each pair of adjacent gun bodies, such as to provide structural separation between interior portions of adjacent gun bodies, while providing structural and/or electrical features supporting the mechanical and/or electrical connection and/or communication therebetween. For example, the bulkhead may help pressure isolate the adjacent gun bodies from each other and optionally from an external environment. The bulkhead may also provide electrical connections to facilitate electrical communication between adjacent gun bodies, such as to convey electrical power and signals (detonation signals, wireless addressing, and so forth) among the various guns of the perforating assemblies.

In some example configurations, adjacent perforating gun bodies of the perforating gun assembly are threaded to each other with a threaded connection. The bulkhead may be housed at least partially within one or both of the adjacent gun bodies and may have a threadless exterior surface that spans the connection between the adjacent gun bodies. Outwardly threadless in this context refers to a lack of a profile along a portion of an external surface, where the profile is engageable to a matching profile or a substantially matching profile along a surface of the perforating gun assembly or a component of the perforating gun assembly. In some example configurations, outwardly threadless refers to a lack of a helical shaped external profile, such as a screw shaped profile along a portion of the external surface. In some example configurations, outwardly threadless refers to a smooth profile, a substantially smooth profile, or a lack of any threaded profiles (such as, but not limited to vee thread, square thread, acme thread, buttress thread, multi-start thread, or other types of threaded profiles) along a portion of the external surface. In some example configurations, the outwardly threadless feature of the bulkhead reduces or eliminates the complexity of the bulkhead, thereby making the bulkhead easier and more cost effective to produce and to fit onto the perforating gun assembly.

Figure 2:
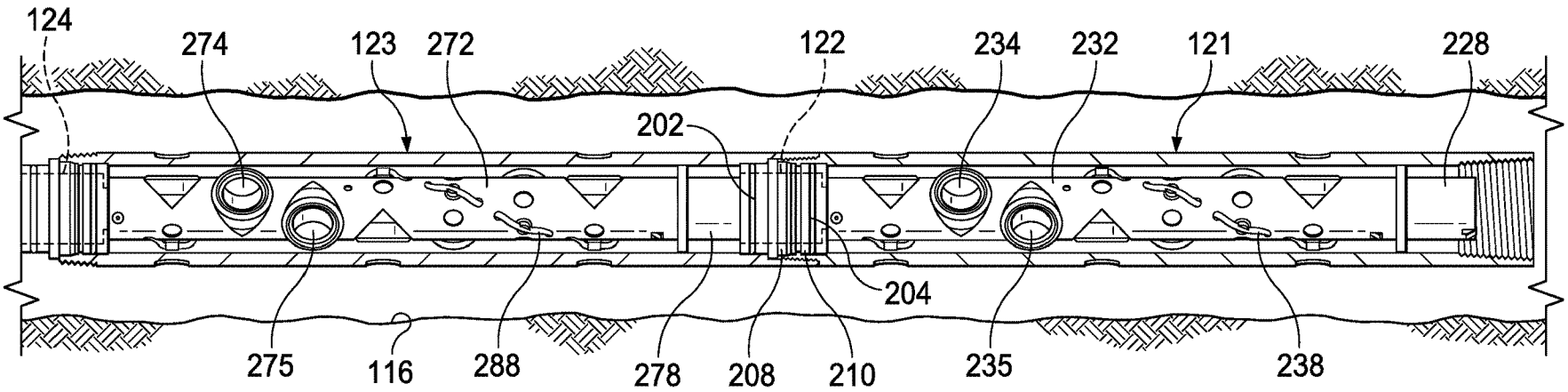
FIG. 2 is an enlarged view of the perforating gun assembly of FIG. 1 having a bulkhead coupled to adjacent perforating guns and deployed in a wellbore of FIG. 1.

In some example configurations, the bulkhead is positioned around adjacent perforating guns that are threaded to each other along a threaded connection (as shown in FIG. 2). In one or more of such example configurations, the bulkhead spans the length of the threaded connection and mates with the interior of the gun body. In one or more of such example configurations, the bulkhead is configured to seal explosive pressure from the adjacent perforating guns to protect the threads of the adjacent perforating guns from distortion, galling, and disfigurement caused by explosive pressure, such as pressure generated by firing of one or more perforating guns of the perforating gun assembly. In one or more of such example configurations, the bulkhead is configured to prevent or reduce the likelihood of fracturing or dislodging of components of the perforating gun assembly that are disposed within the bulkhead.

In some embodiments, the bulkhead has one or more alignment features (such as alignment features illustrated in FIGS. 2 and 3) that align the bulkhead with other components of the perforating gun assembly (such as a charge tube, gun body, or another component of the perforating gun assembly). In one or more of such embodiments, one or more components of the perforating gun (such as the charge tube) is rotatable with respect to, or within the bulkhead until the alignment feature is aligned with or locked to a corresponding mating feature. In one or more of such embodiments, the one or more components are no longer rotatable with respect to or within the bulkhead once the alignment feature aligns with or locks to the corresponding mating feature. In some embodiments, the bulkhead includes a locking mechanism that locks a component (such as the charge tube, gun body, or another component of the perforating gun assembly) to the bulkhead after the component is aligned with the bulkhead. Examples of locking mechanisms include, but are not limited to, springs, machined and casted components, as well as other locking components that facilitate locking of the bulkhead.

In some embodiments, the bulkhead also has a notch that is positioned between the two exterior grooves. In some embodiments, the notch is engineered to provide a bearing surface to withstand detonation and other operations where pressure exerted on the threaded connection is greater than a threshold pressure (e.g., 1,000 psi, 5,000 psi, or another threshold psi). In one or more of such embodiments, the notch has an angled surface along one side of the notch, where the angled surface is engineered to increase the bearing strength of the notch. In one or more of such embodiments, the notch includes multiple angled surfaces along one or opposite sides of the notch to increase the bearing strength of the notch. Additional descriptions of the notch are provided in the paragraphs below.

In some embodiments, the bulkhead also includes an interior pass through. In some embodiments, the interior pass through houses components of the perforating gun assembly, such as electrical connections, as well as other components of the perforating gun assembly. In one or more of such embodiments, the interior pass through is defined or partially defined by a threaded surface that fastens components of the perforating gun assembly to the bulkhead. In one or more of such embodiments, the interior pass through contains a feed through with variable geometry that expands radially via axial compression. In one or more of such embodiments, the bulkhead includes an electrical sealing element disposed in the interior pass through to seal the electrical connections and to insulate the electrical connections. In one or more of such embodiments, the bulkhead also includes a compressible retainer that, when compressed, pressure seals the components of the bulkhead within the interior pass through. In some embodiments, the bulkhead also includes an electrical ground for electrical connections of the perforating gun assembly.

In one or more example configurations, the bulkhead also includes a first sealing element between the bulkhead and one perforating gun and a second sealing element positioned between the bulkhead and the adjacent perforating gun. The sealing elements may form a pressure barrier where the threaded connection of the adjacent perforating guns is positioned in between the sealing elements. The seals formed around the threaded connection reduce or eliminate pressure, swelling, and distortion of the threaded connection due to charge detonation and other perforating operations.

In some embodiments, the bulkhead has grooves that extend around the exterior surface of the bulkhead. In one or more of such embodiments, the bulkhead has exterior grooves that extend circumferentially around the exterior surface, where the threaded connection of the adjacent guns is positioned in between the two exterior grooves. In some embodiments, the sealing elements are partially or completely disposed within the exterior grooves. In some example configurations, a single bulkhead described herein is utilized in lieu of multiple components of a perforating gun assembly that are fitted onto or inside the perforating gun assembly to protect the threaded connection of adjacent perforating guns from disfigurement, thereby reducing the complexity of the perforating gun assembly. Additional descriptions of bulkheads and perforating gun assemblies are described in the paragraphs below and are illustrated in FIGS. 1-5B.

Now turning to the figures, FIG. 1 illustrates a schematic view of a well 112 having a perforating gun assembly 119 deployed in a wellbore 116 during well completion to perforate wellbore 116 and form or enhance perforations in the surrounding formation 120. Well 112 includes wellbore 116 that extends from surface 108 of well 112 to a subterranean substrate or formation 120. Well 112 and rig 104 are illustrated onshore in FIG. 1. Alternatively, the operations described herein and illustrated in the figures are performed in an off-shore environment.

In the embodiment illustrated in FIG. 1, wellbore 116 has been formed by a drilling process in which dirt, rock and other subterranean material are removed to create wellbore 116. In some embodiments, a portion of wellbore 116 is cased with a casing (not illustrated). In other embodiments, wellbore 116 is maintained in an open-hole configuration without casing. The embodiments described herein are applicable to either cased or open-hole configurations of wellbore 116, or a combination of cased and open-hole configurations in a particular wellbore.

After drilling of wellbore 116 is complete and the associated drill bit and drill string are "tripped" from wellbore 116, a conveyance 150, which may be a drill string, drill pipe, coiled tubing, production tubing, wireline, downhole tractor or another type of conveyance deployable in a wellbore, is lowered into wellbore 116. In some embodiments, conveyance 150 includes an interior 194 disposed longitudinally in conveyance 150 that provides fluid communication between the surface 108 of well 112 of FIG. 1 and a downhole location in formation 120, where conveyance 150 provides a fluid flow path for fluids to flow into a region exterior of perforating gun assembly 119, and from the region uphole, where the fluid flows uphole, through an outlet conduit 198, and into a container 178. In some embodiments, where conveyance 150 is a wireline, wellbore 116 provides fluid flow paths for fluids to flow downhole and uphole to container 178. In some embodiments, one or more pumps (not shown) are utilized to facilitate fluid flow downhole or uphole.

In the embodiment of FIG. 1, conveyance 150 is lowered by a lift assembly 154 associated with a derrick 158 positioned on or adjacent to rig 104 as shown in FIG. 1. Lift assembly 154 includes a hook 162, a cable 166, a traveling block (not shown), and a hoist (not shown) that cooperatively work together to lift or lower a swivel 170 that is coupled to an upper end of conveyance 150. In some embodiments, conveyance 150 is raised or lowered as needed to add additional sections of tubing to conveyance 150 to position perforating gun assembly 119 at a desired depth or zone in wellbore 116.

Perforating gun assembly 119 includes a first perforating gun 121, an adjacent second perforating gun 123, and a bulkhead 122 that is positioned between first perforating gun 121 and second perforating gun 123. In the embodiment of FIG. 1, bulkhead 122 is housed inside a gun body of perforating gun assembly 119. Bulkhead 122 has a threadless exterior surface that spans at least the length of a threaded connection between first perforating gun 121 and second perforating gun 123. Additional descriptions of bulkhead 122 are provided in the paragraphs below and are illustrated in at least FIGS. 2 and 3. In some embodiments, after firing of perforating gun assembly 119, perforating gun assembly 119 is lowered or lifted to another location or zone in wellbore 116 to initiate firing of the perforating gun assembly 119 at the second location or zone. In some embodiments, perforating gun assembly 119 is lifted to surface 108 without firing into formation 120.

Although FIG. 1 depicts perforating gun assembly 119 as having two perforating guns 121 and 123 and one bulkhead 122 positioned in between two perforating guns 121 and 123, in some embodiments, perforating gun assembly 119 has additional perforating guns (not shown) and additional bulkheads (not shown) positioned between adjacent perforating guns. Further, although FIG. 1 illustrates one perforating gun assembly 119, in some embodiments, multiple perforating gun assemblies (not shown), each having one or more bulkheads (not shown) positioned between adjacent perforating guns, are simultaneously deployed by conveyance 150 to different desirable depths. In one or more of such embodiments, the multiple perforating guns are simultaneously or sequentially initiated to simultaneously or sequentially fire into formation 120.

FIG. 2 is an enlarged view of perforating gun assembly 119 of FIG. 1 having bulkhead 122 coupled to adjacent first perforating gun 121 and second perforating gun 123 and deployed in wellbore 116 of FIG. 1. In the embodiment of FIG. 2, first perforating gun 121 includes an interconnected charge tube 232 containing charges 234 and 235, such as perforating charges, and a detonator sleeve 228 configured to receive a detonator (not shown). In some embodiments, detonator sleeve 228 is attached to charge tube 232 and is partially housed in charge tube 232. In one or more of such embodiments, bulkhead 122, charge tube 232, and detonator sleeve 228 are inserted on an uphole end (such as a pin end or left end) and the detonator is inserted on an opposite downhole end (such as box end or right end). In the embodiment of FIG. 2, charges 234 and 235 are interconnected with a detonation cord 238 that provides a transmission medium to setoff charges 234 and 235. In some embodiments, where charges 234 and 235 are not interconnected by detonation cord 238, charges 234 and 235 are remotely setoff or setoff after a predetermined amount of time. Similarly, second perforating gun 123 also includes an interconnected charge tube 272 containing charges 274 and 275 and detonation cord 288, and a detonator sleeve 278 configured to receive a detonator (not shown).

In the embodiment of FIG. 2, first and second perforating guns 121 and 123 are configured to be selectively fired, such that each of first perforating gun 121 and second perforating gun 123 is operable to fire at the same time as, or at different times from, firing one or more of additional perforating guns (not shown) of perforating gun assembly 119. Further, in some embodiment, each perforating gun 121 or 123 is operable to selectively setoff one or more charges, such as charges 234 and 235 at the same time, or at different times from each other. In one or more embodiments, each perforating gun includes a selective firing module (not shown) and electrical conductors (such as, but not limited to wires, conductive ribbons, traces, as well as other types of electrical conductors) extending along the respective perforating gun to facilitate selective firing of the respective perforating gun. In one or more of such embodiments, the electrical conductors electrically connect the selective firing modules to a source (e.g., a wireline, a telemetry transceiver, etc.) of an electrical signal. In one or more of such embodiments, conveyance 150 of FIG. 1 or perforating gun assembly 119 includes a telemetry transceiver (not shown) configured to receive a telemetry signal (e.g., via pressure pulse, acoustic, electromagnetic, optical or another form of telemetry), and in response transmit an electrical signal to the selective firing modules. In one or more of such embodiments, each selective firing module is individually addressable (e.g., with each module having a unique IP address), so that a predetermined signal will cause firing of a respective selected one of the explosive assemblies. In one or more of such embodiments, multiple modules are configured to respond to the same signal to cause firing of corresponding perforating guns in keeping with the scope of this disclosure.

First and second perforating guns 121 and 123 are connected by threads which retain the bulkhead 122. More particularly, the threaded connections (shown in FIG. 3) of first and second perforating guns 121 and 123 are positioned between sealing elements that partially or completely fill exterior grooves 202 and 204 of bulkhead 122. Additional descriptions of threaded connections and sealing elements are provided in the paragraphs below and are illustrated in at least FIG. 3.

Bulkhead 122 includes an alignment feature 208 that facilitates alignment of bulkhead 122 with first perforating gun 121. In some embodiments, bulkhead 122 and charge tube 232 are freely rotatable with respect to each other during and after assembly until alignment feature 208 mates with a corresponding mating feature (not shown) on charge tube 232. Moreover, bulkhead 122, charge tube 232, charges 234 and 235, and detonator sleeve 228 are restricted from rotational movement after alignment feature 208 mates with the mating feature.

Bulkhead 122 also includes an electrical ground 210 that provides grounding of one or more electrical conductors of first perforating gun 121 and second perforating gun 123. Additional descriptions of components of bulkheads for perforating guns are provided in the paragraphs below and are illustrated in at least FIGS. 3-5B.

In the embodiment of FIG. 2, a second bulkhead 124 is positioned around threaded connections of second perforating gun 123 and a third perforating gun (not shown). Moreover, second perforating gun 123 and the third perforating gun are connected by threads which retain bulkhead 124. In some embodiments, perforating gun assembly 119 includes additional adjacent perforating guns and additional bulkheads (not shown) that are positioned around threaded connections of the adjacent perforating guns. Further, although FIG. 2 illustrates each of charge tubes 232 and 272 having two charges 234 and 235, and 274 and 275, respectively, in some embodiments, different charge tubes of perforating gun assembly 119 hold different numbers of charges. Further, charges 234 and 235 are illustrated to have a certain orientation relative to each other, in some embodiments, charges 234 and 235 have the same orientation, or are orientated in a different orientation (such as 45° relative to each other, 60° relative to each other, 90° relative to each other, or another number of degrees relative to each other) than the orientation illustrated in FIG. 2. Further, although FIG. 2 illustrates detonator sleeves 228 and 278 that are fixed to the end of the charge tubes 232 and 272 respectively, and are configured to receive a detonator (not shown), in some embodiments, perforating guns 121 and 123 do not include any detonator sleeve 228 or 278.

Figure 3:
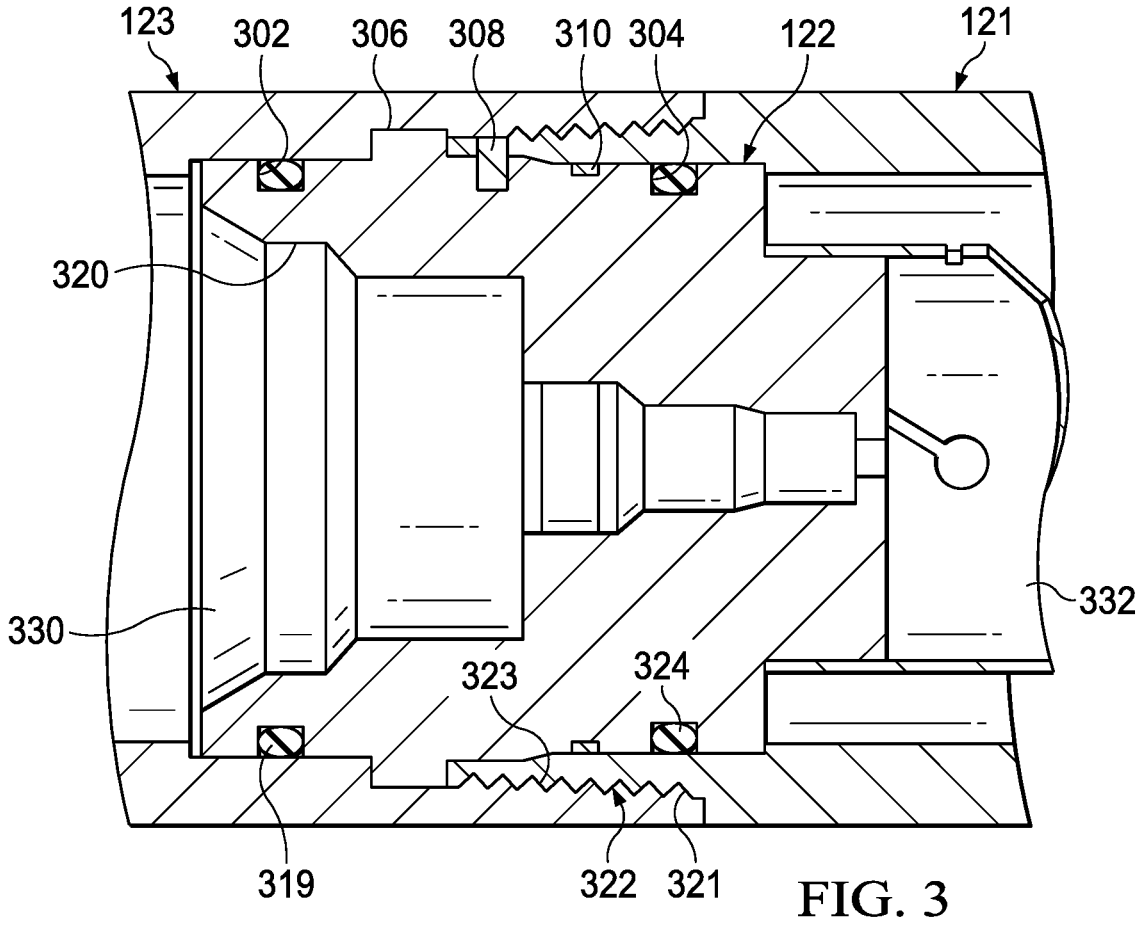
FIG. 3 is a schematic, cross-sectional view of a bulkhead of the perforating gun assembly of FIG. 1.

FIG. 3 is a schematic, cross-sectional view of bulkhead 122 of perforating gun assembly 119 of FIG. 1. In the embodiment of FIG. 3, bulkhead 122 is positioned between first perforating gun 121 and adjacent second perforating gun 123 of perforating gun assembly 119. First perforating gun 121 has a threaded surface that is represented by line 321, and second perforating gun 123 has a threaded surface that is represented by line 323. Threaded surfaces 321 and 323 of first perforating gun 121 and second perforating gun 123 are engaged with each other to form a threaded connection, which is presented by line 322.

In the embodiment of FIG. 3, bulkhead 122 has a first exterior groove 302 and a second exterior groove 304 that extend circumferentially around the exterior surface of bulkhead 122. First exterior groove 302 and second exterior groove 304 are positioned around threaded connection 322. In the embodiment of FIG. 3, bulkhead 122 is sealed by sealing elements 319 and 324, which are deposited in first exterior groove 302 and second exterior grove 304, respectively. Sealing elements 319 and 324 include any mechanical, electrical, or electromechanical components that reduce or eliminate pressure, swelling, and/or distortion of threaded surfaces 321, 322, and 323, and to reduce or prevent fluids from contacting electrical components within bulkhead 122. In the embodiment of FIG. 3, sealing elements 319 and 324 are o-rings that are deposited within first exterior groove 302 and second exterior groove 304, respectively, to seal around threaded connection 322 to reduce or eliminate pressure, swelling, and distortion of threaded connection 322 due to charge detonation and other perforating operations. In some embodiments, where bulkhead 122 does not include grooves 302 and 304, sealing elements are positioned between bulkhead 122 and first and second perforating guns 121 and 123 to seal around threaded connection 322 to limit, reduce or eliminate pressure, swelling and distortion of threaded surfaces 321, 322, and 323 as well as prevent fluids, wellbore or otherwise, from contacting electrical components within perforating gun assembly 119 of FIG. 1.

In the embodiment of FIG. 3, bulkhead 122 has a notch 306 that is positioned between first exterior groove 302 and second exterior groove 304. Further, notch 306 floats between first perforating gun 121 and second perforating gun 123. In the embodiment of FIG. 3, notch 306 is engineered to provide a bearing surface to withstand detonation and other operations where pressure exerted on threaded connection 322 is greater than a threshold pressure (e.g., 1,000 psi, 5,000 psi, or another threshold psi).

In the embodiment of FIG. 3, bulkhead 122 also has an alignment piece 308 that facilitates alignment of the bulkhead 122 to the gun body prior to and during perforating operations. In the embodiment of FIG. 3, bulkhead 122 partially houses alignment piece 308. In the embodiment of FIG. 2, alignment piece 308 is aligned with the first shot on charge tube 332. When bulkhead 122 and charge tube 332 are inserted into the perforating gun assembly, alignment piece 308 slides into a mating slot on the gun body so that the charges are shot in scallop. In some embodiments, alignment piece 308 or another alignment feature (not shown) is a built in component of bulkhead 122, where alignment piece 308 mates with an adjacent perforating gun, such as first perforating gun 121 or second perforating gun 123. In some embodiments, bulkhead 122 has a receiving feature (e.g., a groove), and an adjacent perforating gun has an alignment feature (e.g., an alignment piece similar to alignment piece 308) that mates with the receiving feature of bulkhead 122. In one or more of such embodiments, where a bulkhead 122 has a receiving feature such as a groove, the perforating gun does not include an alignment feature, such as alignment piece 308. In one or more of such embodiments, a bulkhead has an alignment feature and a receiving feature. In some embodiments, an alignment piece is fitted to another component of a perforating gun assembly. In one or more of such embodiments, an alignment piece is fitted onto a charge holder of the perforating gun assembly. In one or more of such embodiments, an alignment piece is fitted onto a detonator of the perforating gun assembly. Bulkhead 122 also has an electrical ground 310 for electrical connections of perforating gun assembly 119 of FIG. 1.

Bulkhead 122 has an interior pass through 320 that is configured to fit components of perforating gun assembly 119 of FIG. 1 partially or completely within interior pass through 320. In the embodiment of FIG. 3, a detonator 330 of perforating gun assembly 119 is fitted inside interior pass through 320. In some embodiments, interior pass through 320 has a threaded surface along interior pass through 320 that fastens detonator 330 or other components disposed inside interior pass through 320.

Figure 4A:
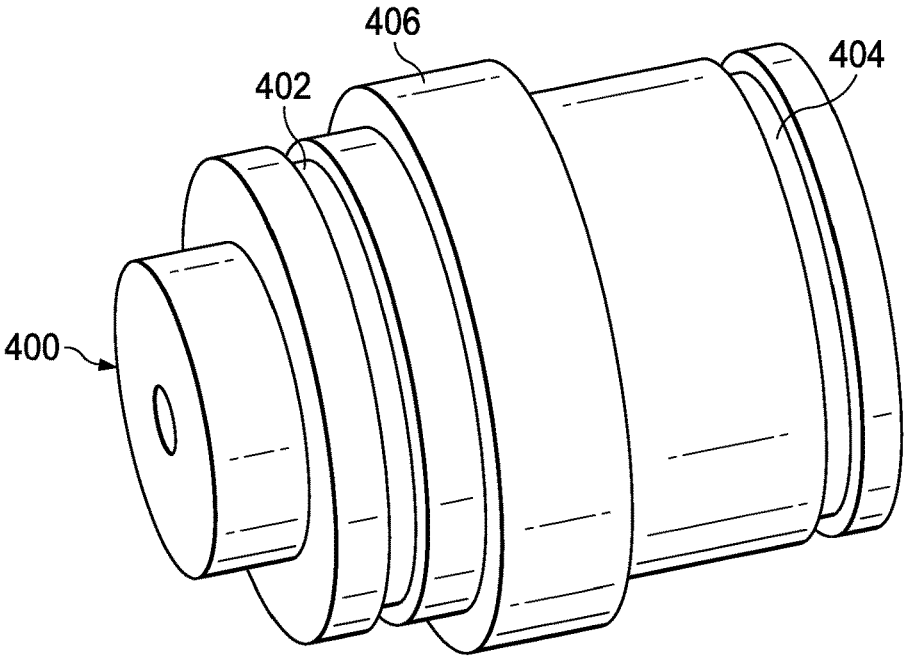
FIG. 4A is a schematic, exterior view of a bulkhead similar to the bulkhead of FIG. 3.

FIG. 4A is a schematic, exterior view of a bulkhead 400 similar to bulkhead 122 of FIG. 3. In the embodiment of FIG. 4A, the exterior of bulkhead 400 has a first exterior groove 402 and a second exterior groove 404 that extend circumferentially around the exterior surface of bulkhead 400. After bulkhead 400 is fitted inside a gun body of a perforating gun assembly, such as perforating gun assembly 119 of FIG. 1, first exterior groove 402 and second exterior groove 404 are positioned around a threaded connection of two adjacent perforating guns, such as threaded connection 322 of perforating guns 121 and 123 of FIG. 3 to reduce or eliminate pressure on the threaded connection during perforating operations. Further, bulkhead 400 also includes a notch 406 that is positioned between first exterior groove 402 and second exterior groove 404. In the embodiment of FIG. 4A, notch 406 does not have an angled surface. In some embodiments, notch 406 has one or more angled surfaces.

Figure 4B:
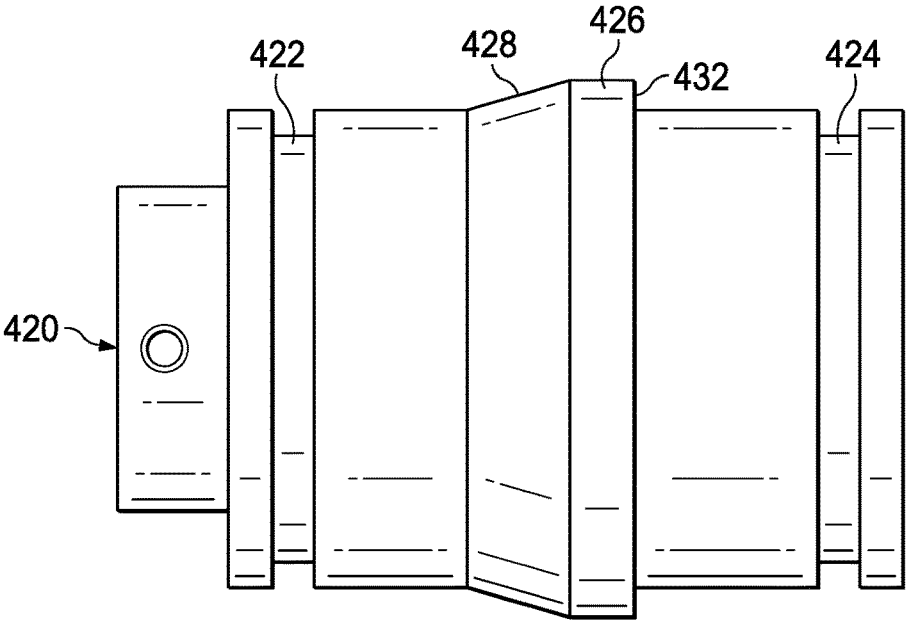
FIG. 4B is a schematic, exterior view of another bulkhead similar to the bulkhead of FIG. 3.

In that regard, FIG. 4B is a schematic, exterior view of another bulkhead 420 similar to bulkhead 122 of FIG. 3. In the embodiment of FIG. 4B, the exterior of bulkhead 420 has a first exterior groove 422 and a second exterior groove 424 that extend circumferentially around the exterior surface of bulkhead 420. Further, bulkhead 420 also includes a notch 426 that is positioned between first exterior groove 422 and second exterior groove 424. In the embodiment of FIG. 4B, notch 426 has an angled surface 428, where angled surface 428 is engineered to increase the bearing strength of notch 426. In the embodiment of FIG. 4B, notch 426 has one angled surface 428. In the embodiment of FIG. 4B, angled surface 428 extends from one side of bulkhead 420. In some embodiments, additional angled surfaces (not shown) extend from second side 432 of notch 426. In some embodiments, notch 426 has multiple angled surfaces (not shown) along one or both sides of notch 426.

Figure 4C:
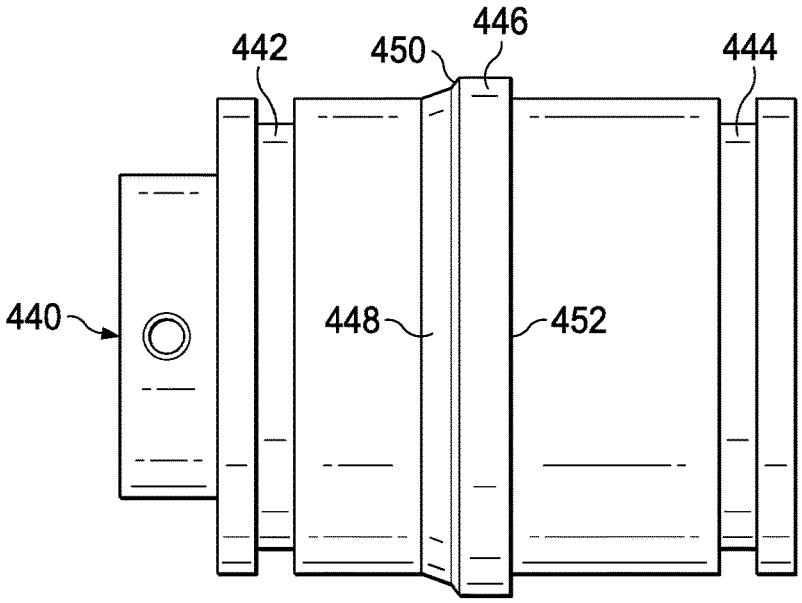
FIG. 4C is a schematic, exterior view of another bulkhead similar to the bulkhead of FIG. 3.

In that regard, FIG. 4C is a schematic, exterior view of another bulkhead 440 similar to bulkhead 122 of FIG. 3. In the embodiment of FIG. 4C, the exterior of bulkhead 440 has a first exterior groove 442 and a second exterior groove 444 that extend circumferentially around the exterior surface of bulkhead 440. Further, bulkhead 440 also includes a notch 446 that is positioned between first exterior groove 442 and second exterior groove 444. In the embodiment of FIG. 4C, notch 446 has a first angled surface 448 and a second angled surface 450, where each of first angled surface 448 and second angled surface 450 is engineered to increase the bearing strength of notch 446. In some embodiments, first and second angled surfaces 448 and 450 are engineered to have different angles of inclination or declination. In the embodiment of FIG. 4C, first angled surface 448 and second angled surface 450 extend from one side of bulkhead 440. In some embodiments, additional angled surfaces (not shown) extend from second side 452 of notch 446.

Figure 4D:
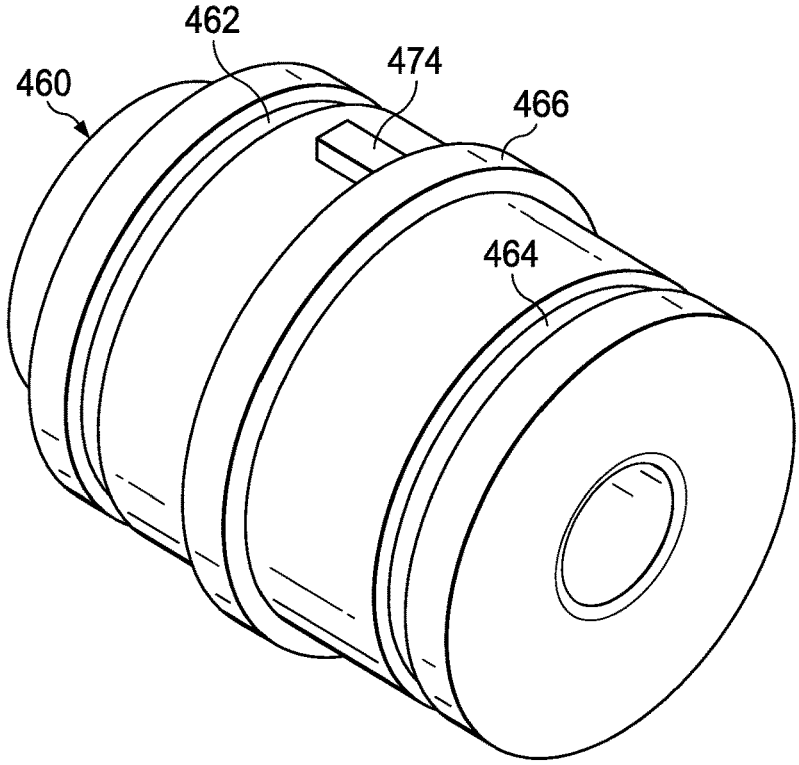
FIG. 4D is a schematic, exterior view of another bulkhead similar to the bulkhead of FIG. 3.

FIG. 4D is a schematic, exterior view of another bulkhead 460 similar to bulkhead 122 of FIG. 3. In the embodiment of FIG. 4D, the exterior of bulkhead 460 has a first exterior groove 462 and a second exterior groove 464 that extend circumferentially around the exterior surface of bulkhead 460. Further, bulkhead 460 also includes a notch 466 that is positioned between first exterior groove 462 and second exterior groove 464. Further, bulkhead 460 also includes an alignment piece 474 that facilitates alignment of bulkhead 460 to the gun body prior to and during perforating operations. Bulkhead 460 of FIG. 4D includes one alignment piece 474. In some embodiments, bulkhead 460 includes multiple alignment pieces (not shown) to facilitate alignment of bulkhead 460 prior to and during perforating operations.

Figure 5A:
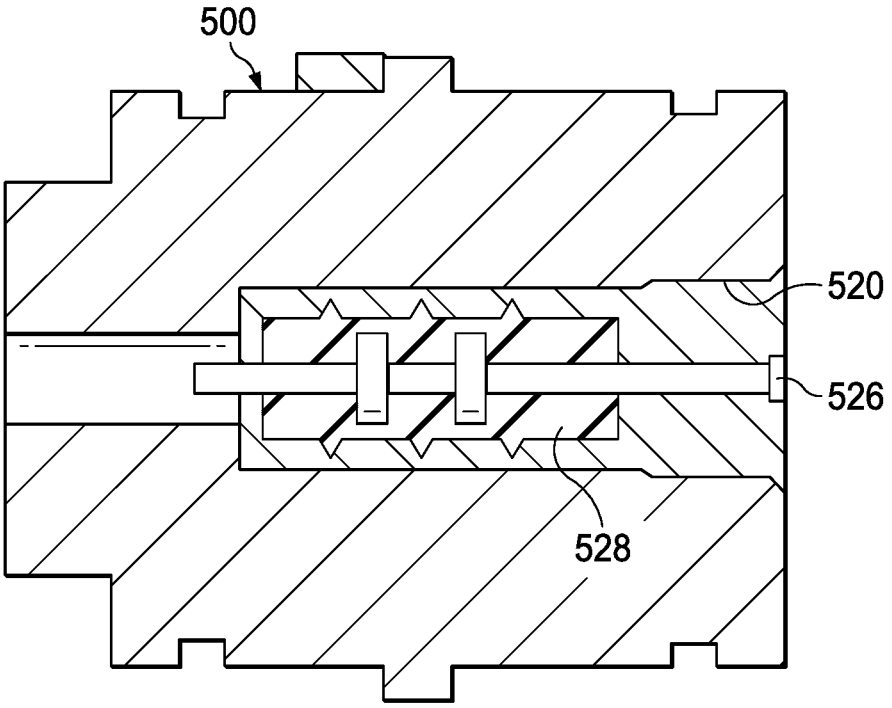
FIG. 5A is a schematic, cross-sectional view of a bulkhead similar to the bulkhead of FIG. 3.

FIG. 5A is a schematic, cross-sectional view of a bulkhead 500 similar to bulkhead 122 of FIG. 3. In the embodiment of FIG. 5A, electrical connections 526 and a sealing element 528 are stored in interior pass through 520 of bulkhead 500. In some embodiments, sealing element 528 also maintains a pressure seal between adjacent perforating guns, such as first perforating gun 121 and second perforating gun 123 of FIG. 1. Sealing element 528 pressure seals portions of electrical connections 526 inside interior pass through 520 of bulkhead 500.

Figure 5B:
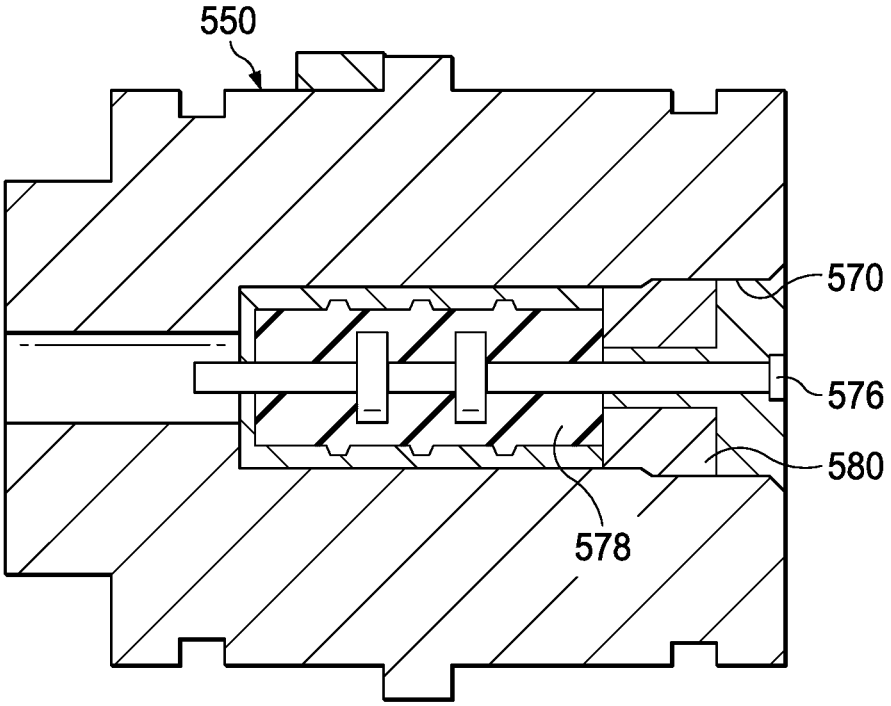
FIG. 5B is a schematic, cross-sectional view of another bulkhead similar to the bulkhead of FIG. 3.

FIG. 5B is a schematic, cross-sectional view of another bulkhead 550 similar to bulkhead 122 of FIG. 3. In the embodiment of FIG. 5B, electrical connections 576 and a sealing element 578 are stored in interior pass through 570 of bulkhead 550. In some embodiments, sealing element 578 also maintains a pressure seal between adjacent perforating guns, such as first perforating gun 121 and second perforating gun 123 of FIG. 1. Bulkhead 550 also includes a compressible retainer 580, which compresses sealing element 578 to pressure seal portions of electrical connections 576 inside interior pass through 570 of bulkhead 550. In one or more of such embodiments, sealing element 578 pressure seals portions of electrical connections 576 while permitting transmission of data and power through electrical connections 576.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a bulkhead for a perforating gun, comprising: a threadless exterior surface that spans a length of a threaded connection of adjacent first and second perforating guns; a first exterior groove having a first sealing element partially disposed in the first exterior groove; and a second exterior groove having a second sealing element partially disposed in the second exterior groove, wherein the first sealing element and the second sealing element are positioned around the threaded connection.

Clause 2, the bulkhead of clause 1, further comprising a notch positioned between the first perforating gun and the second perforating gun.

Clause 3, the bulkhead of clause 2, wherein the notch comprises an angled surface.

Clause 4, the bulkhead of clause 3, wherein the angled surface is disposed on a first side of the notch, and wherein the notch comprises a second angled surface that is disposed on a second side that is opposite of the first side.

Clause 5, the bulkhead of any of clauses 1-4, further comprising an alignment piece disposed on the exterior surface.

Clause 6, the bulkhead of any of clauses 1-5, further comprising an interior pass through that houses one or more components of a perforating gun assembly within the bulkhead.

Clause 7, the bulkhead of clause 6, further comprising: an electrical sealing element disposed within the interior pass through; and a compressible retainer, wherein compression of the compressible retainer pressure seals the one or more components of the perforating gun assembly.

Clause 8, the bulkhead of any of clauses 6 or 7, wherein the interior pass through comprises a threaded surface that fastens the one or more components of the perforating gun assembly to the bulkhead.

Clause 9, the bulkhead of any of clauses 1-8, wherein the first sealing element is completely disposed within the first exterior groove, and wherein the second sealing element is completely disposed within the second exterior groove.

Clause 10, the bulkhead of any of clauses 1-9, further comprising an electrical ground.

Clause 11, the bulkhead of any of clauses 1-10, wherein the bulkhead is fitted inside a gun body of a perforating gun assembly.

Clause 12, a perforating gun assembly, comprising: a first perforating gun; a second perforating gun; and a bulkhead, comprising: a threadless exterior surface that spans a length of a threaded connection of the first perforating gun and the second perforating gun; a first sealing element; and a second sealing element, wherein the first sealing element and the second sealing element are positioned around the threaded connection.

Clause 13, the perforating gun assembly of clause 12, further comprising a notch positioned between the first perforating gun and the second perforating gun.

Clause 14, the perforating gun assembly of clause 13, wherein the notch comprises an angled surface.

Clause 15, the perforating gun assembly of clause 14, wherein the notch comprises a second angled surface, and wherein the angled surface is disposed on a first side of the notch and wherein the second angled surface is disposed on a second and opposite side of the notch.

Clause 16, the perforating gun assembly of any of clauses 12-15, further comprising an alignment piece disposed on the exterior surface.

Clause 17, the perforating gun assembly of any of clauses 12-16, further comprising an interior pass through that houses one or more components of the perforating gun assembly within the bulkhead.

Clause 18, the perforating gun assembly of clause 17, further comprising: an electrical sealing element disposed within the interior pass through; and a compressible retainer, wherein compression of the compressible retainer pressure seals the one or more components of the perforating gun assembly.

Clause 19, the perforating gun assembly of any of clauses 17 or 18, wherein the interior pass through comprises a threaded surface that fastens the one or more components of the perforating gun assembly to the bulkhead.

Clause 20, the perforating gun assembly of any of clauses 12-19, wherein the bulkhead is partially housed inside a gun body of the perforating gun assembly.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A bulkhead for a perforating gun, comprising:

a threadless exterior surface that spans an entire length of a threaded connection of adjacent first and second perforating guns;

a first exterior groove having a first sealing element partially disposed in the first exterior groove; and a second exterior groove having a second sealing element partially disposed in the second exterior groove;

an interior pass through that houses one or more components of a perforating gun assembly within the bulkhead an electrical sealing element disposed within the interior pass through; and a compressible retainer, wherein compression of the compressible retainer pressure seals the one or more components of the perforating gun assembly, wherein the threaded connection is positioned in between the first sealing element and the second sealing element.

2. The bulkhead of claim 1, further comprising a notch positioned between the first perforating gun and the second perforating gun.

3. The bulkhead of claim 2, wherein the notch comprises an angled surface.

4. The bulkhead of claim 3, wherein the angled surface is disposed on a first side of the notch, and wherein the notch comprises a second angled surface that is disposed on a second side that is opposite of the first side.

5. The bulkhead of claim 1, further comprising an alignment piece disposed on the exterior surface.

6. The bulkhead of claim 1, wherein the interior pass through comprises a threaded surface that fastens the one or more components of the perforating gun assembly to the bulkhead.

7. The bulkhead of claim 1, wherein the first sealing element is completely disposed within the first exterior groove, and wherein the second sealing element is completely disposed within the second exterior groove.

8. The bulkhead of claim 1, further comprising an electrical ground.

9. The bulkhead of claim 1, wherein the bulkhead is fitted inside a gun body of a perforating gun assembly.

10. A perforating gun assembly, comprising:

a first perforating gun;

a second perforating gun; and a bulkhead, comprising:

a threadless exterior surface that spans an entire of a threaded connection of the first perforating gun and the second perforating gun;

a first sealing element;

a second sealing element;

an interior pass through that houses one or more components of the perforating gun assembly within the bulkhead;

an electrical sealing element disposed within the interior pass through; and a compressible retainer, wherein compression of the compressible retainer pressure seals the one or more components of the perforating gun assembly, wherein the threaded connection is positioned in between the first sealing element and the second sealing element.

11. The perforating gun assembly of claim 10, further comprising a notch positioned between the first perforating gun and the second perforating gun.

12. The perforating gun assembly of claim 11, wherein the notch comprises an angled surface.

13. The perforating gun assembly of claim 12, wherein the notch comprises a second angled surface, and wherein the angled surface is disposed on a first side of the notch and wherein the second angled surface is disposed on a second and opposite side of the notch.

14. The perforating gun assembly of claim 10, further comprising an alignment piece disposed on the exterior surface.

15. The perforating gun assembly of claim 10, wherein the interior pass through comprises a threaded surface that fastens the one or more components of the perforating gun assembly to the bulkhead.

16. The perforating gun assembly of claim 10, wherein the bulkhead is partially housed inside a gun body of the perforating gun assembly.

* * * * *